US008746350B2

(12) United States Patent
Bryson

(10) Patent No.: US 8,746,350 B2
(45) Date of Patent: Jun. 10, 2014

(54) TUBING HANGER SHUTTLE VALVE

(75) Inventor: William Thomas Bryson, Montrose Angus (GB)

(73) Assignee: Vetco Gray Inc., Houston, TX (US)

( * ) Notice: Subject to any disclaimer, the term of this patent is extended or adjusted under 35 U.S.C. 154(b) by 400 days.

(21) Appl. No.: 12/976,160

(22) Filed: Dec. 22, 2010

(65) Prior Publication Data

US 2012/0160513 A1 Jun. 28, 2012

(51) Int. Cl.
*E21B 7/12* (2006.01)

(52) U.S. Cl.
USPC ..... 166/348; 166/95.1; 166/88.1

(58) Field of Classification Search
USPC ..... 166/368, 348, 95.1, 88.1, 86.1, 86.2
See application file for complete search history.

(56) References Cited

U.S. PATENT DOCUMENTS

| | | | | |
|---|---|---|---|---|
| 3,688,841 | A * | 9/1972 | Baugh | 166/89.2 |
| 3,982,417 | A * | 9/1976 | Cailloux | 72/453.01 |
| 4,869,318 | A * | 9/1989 | Kellett | 166/321 |
| 5,143,158 | A * | 9/1992 | Watkins et al. | 166/344 |
| 6,638,364 | B2 | 10/2003 | Harkins | |
| 7,219,741 | B2 | 5/2007 | Fenton | |
| 2002/0029887 | A1 | 3/2002 | Baskett et al. | |

FOREIGN PATENT DOCUMENTS

| | | | |
|---|---|---|---|
| GB | 2243383 | A | 10/1991 |
| GB | 2342668 | A | 4/2000 |
| GB | 2376492 | A | 12/2002 |
| GB | 2377954 | A | 1/2003 |
| GB | 2394494 | A | 4/2004 |

OTHER PUBLICATIONS

GB Partial Search Report dated Feb. 28, 2012 from corresponding Application No. GB1121163.8.
GB Search Report dated Apr. 20, 2012 from corresponding Application No. GB1121163.8.

* cited by examiner

*Primary Examiner* — Kenneth L Thompson
*Assistant Examiner* — Ronald Runyan
(74) *Attorney, Agent, or Firm* — Bracewell & Giuliani LLP

(57) ABSTRACT

A wellhead assembly made up of a wellhead housing, a production tree mounted on the wellhead housing, tubing suspended into a wellbore from within the wellhead housing, and an annulus between the tubing and the wellhead housing. A shuttle valve is provided within a tubing hanger that supports the tubing from within the wellhead housing. An accumulator is disposed in the annulus that is in fluid communication with a closed position port on the shuttle valve. Pressure is maintained in the accumulator for closing the shuttle valve when a force for opening the valve is removed.

13 Claims, 6 Drawing Sheets

TUBING HANGER SHUTTLE VALVE

1. FIELD OF THE INVENTION

This invention relates in general to production of oil and gas wells, and in particular to a wellhead assembly having a shuttle valve moveable in one direction by pressurized fluid.

2. DESCRIPTION OF RELATED ART

Wellheads used in the production of hydrocarbons extracted from subterranean formations typically comprise a wellhead assembly attached at the upper end of a wellbore formed into a hydrocarbon producing formation. Wellhead assemblies usually provide support hangers for suspending production tubing and casing into the wellbore. The casing lines the wellbore, thereby isolating the wellbore from the surrounding formation. The tubing typically lies concentric within the casing and provides a conduit therein for producing the hydrocarbons entrained within the formation.

Wellhead assemblies also typically include a wellhead housing adjacent where the casing and tubing enter the wellbore, and a production tree atop the wellhead housing. The production tree is commonly used to control and distribute the fluids produced from the wellbore and selectively provide fluid communication or access to the tubing, casing, and/or annuluses between the tubing and casing. Valves assemblies are typically provided within wellhead production trees for controlling fluid flow across a wellhead, such as production flow from the borehole or circulating fluid flow in and out of a wellhead.

In a type of wellhead system, a concentric tubing hanger lands in the wellhead housing thereby extending tubing into the wellbore and forming an annulus between the tubing and casing that lines the wellbore. A tubing annulus valve is generally located in the tubing hanger since a plug cannot be temporarily installed and retrieved from the tubing annulus passage with this type of tree.

A prior art example of a wellhead assembly 10 is shown in a side partial sectional view in FIG. 1. The wellhead assembly 10 has an annular wellhead housing 12 on its outer periphery and a tubing hanger 14 concentrically landed within the wellhead housing 12. Tubing 16 depends downward from the tubing hanger 14 to within casing 18. The casing 18 is suspended from a casing hanger 20 landed within the wellhead housing 12 below the tubing hanger 14. A tubing annulus 22 is formed in the annular space between the tubing 16 and tubing hanger 14 and casing 18 and casing hanger 20. A seal in the annulus 22 prevents pressure communication between wellbore pressure and ambient.

From time to time access to the annulus 22 and beneath the seal may be required for various downhole operations. Accordingly, shuttle valves 24 are included for fluid communication through the wellhead assembly 10 and into the annulus 22. In the prior art example of FIG. 1, the shuttle valves 24 are shown substantially parallel with the tubing 16 and disposed in cavities formed within the tubing hanger 14. Typically, the shuttle valves 24 are hydraulically actuated and having a piston therein that selectively moves between an open and closed position. An example of an opening line 26 is shown delivering hydraulic fluid to a side of the piston to move the shuttle valve into an open position that communicates pressure in the annulus 22 through the tubing hanger 14, where it can then be routed to outside of the wellhead housing 10. Pressure communication to outside of the wellhead housing 10 is illustrated by a flow passage 30 formed through the wellhead housing and into connection with the shuttle valve 24. Thus when the shuttle valve is an open position a flow path is formed through the wellhead housing within the passage 30, through the shuttle valve 24 and into the annulus 22. Also shown is a closing line 28 that delivers hydraulic fluid for closing the shuttle valve 24 to block pressure communication through the tubing hanger 14. The opening closing lines 26, 28 each occupy space within the wellhead housing 10.

SUMMARY OF THE INVENTION

Disclosed herein is an example of a wellhead assembly, that in an example embodiment includes a tubing hanger in a wellhead member and tubing attached to the tubing hanger that inserts into a wellbore. An annulus encircles the tubing. Also included is a shuttle valve assembly in the tubing hanger; where the shuttle valve includes a sleeve, a valve close port, a valve open port, and a piston selectively slidable within the sleeve to a closed position with an amount of pressure applied to the valve close port and the piston selectively slidable to an open position with an amount of pressure applied to the valve open port. In the example embodiment, a flow path extends through the tubing hanger, into the tubing annulus, and through the shuttle valve assembly when the piston is in an open position. An accumulator is included in this example embodiment that is in the annulus and in fluid communication with the valve close port. In an alternative embodiment, the wellhead member can be a wellhead housing or a production tree. The accumulator can be pressurized to a pressure above an ambient pressure. A spring may be optionally included that is biased to urge the shuttle valve into the closed position. In an alternative embodiment, the piston moves into the open position from pressure communication with a passage in the wellhead member and moves into the closed position from pressure communication with the accumulator. In an alternative embodiment, when the valve is moved into the valve open position, pressure in the accumulator maintains a force on the piston to urge the piston toward the closed position. In an alternative embodiment, the shuttle valve assembly is a first shuttle valve assembly and wherein the flow path is a first flow path; in this alternative embodiment a second shuttle valve assembly is included substantially similar to the first shuttle valve assembly.

An alternative example embodiment of a wellhead assembly is described herein, in the alternative example embodiment the wellhead assembly includes a wellhead member with a tubing hanger set therein and tubing hanging from the tubing hanger into a wellbore. The tubing is surrounded by a tubing annulus. In the alternative example embodiment, a shuttle valve is included in the tubing hanger; the shuttle valve is made up of an opening port in fluid communication with pressurized fluid for directing pressure within a portion of the shuttle valve for selectively positioning the shuttle valve into an open position, a flow path extending through the tubing hanger, into the tubing annulus, and through the shuttle valve when the shuttle valve is in the open position, and an accumulator in the tubing annulus in fluid communication with a closing port on the shuttle valve for directing pressure within another portion of the shuttle valve for selectively positioning the shuttle valve into a closed position. In an example embodiment, the shuttle valve has a sleeve and a piston selectively slidable within the sleeve to close the shuttle valve with an amount of pressure applied to the closing port and the piston selectively slidable to open the shuttle valve with an amount of pressure applied to the shuttle valve opening port. In an example embodiment, when the shuttle valve is moved into the shuttle valve open position, pressure in the accumulator maintains a force on the piston to urge the piston in a direction to close the shuttle valve. In an example embodiment, when the valve is moved into the valve open position, pressure in the accumulator maintains a force on the piston to urge the piston toward the closed position. In an example embodiment, the accumulator is suspended in an annulus between a portion of a tubing hanger and a wellhead housing. In an example embodiment, the shuttle valve is actuated into the open position by pressurized fluid in a single line passing through the wellhead housing and actuated into the closed position by pressure in the accumulator. In an example embodiment, another substantially similar shuttle valve is included. In an example embodiment, the accumulator is in fluid communication with a closing port on the second shuttle valve for directing pressure within another portion of the second shuttle valve for selectively positioning the second shuttle valve into a closed position. Optionally, more than one accumulator can be included.

Also disclosed herein is a method of controlling flow through a wellhead assembly. In an example embodiment the method includes providing a shuttle valve in a bore of a tubing hanger. The shuttle valve can be opened by applying pressure, such as through a fluid. This allows flow into a flow passage that extends within an annulus between the tubing hanger and a wellhead housing, through the open shuttle valve and outside of the wellhead assembly. Opening the valve also in turn pressurizes a closing side of the shuttle valve. The pressure in the closing side is stored for later use to close the shuttle valve. In an alternative embodiment, storing pressure can involve directing pressure from the closing side of the shuttle valve to an accumulator. In an alternative embodiment, the accumulator is a closed system disposed in the annulus.

DETAILED DESCRIPTION OF THE INVENTION

Figure 1:
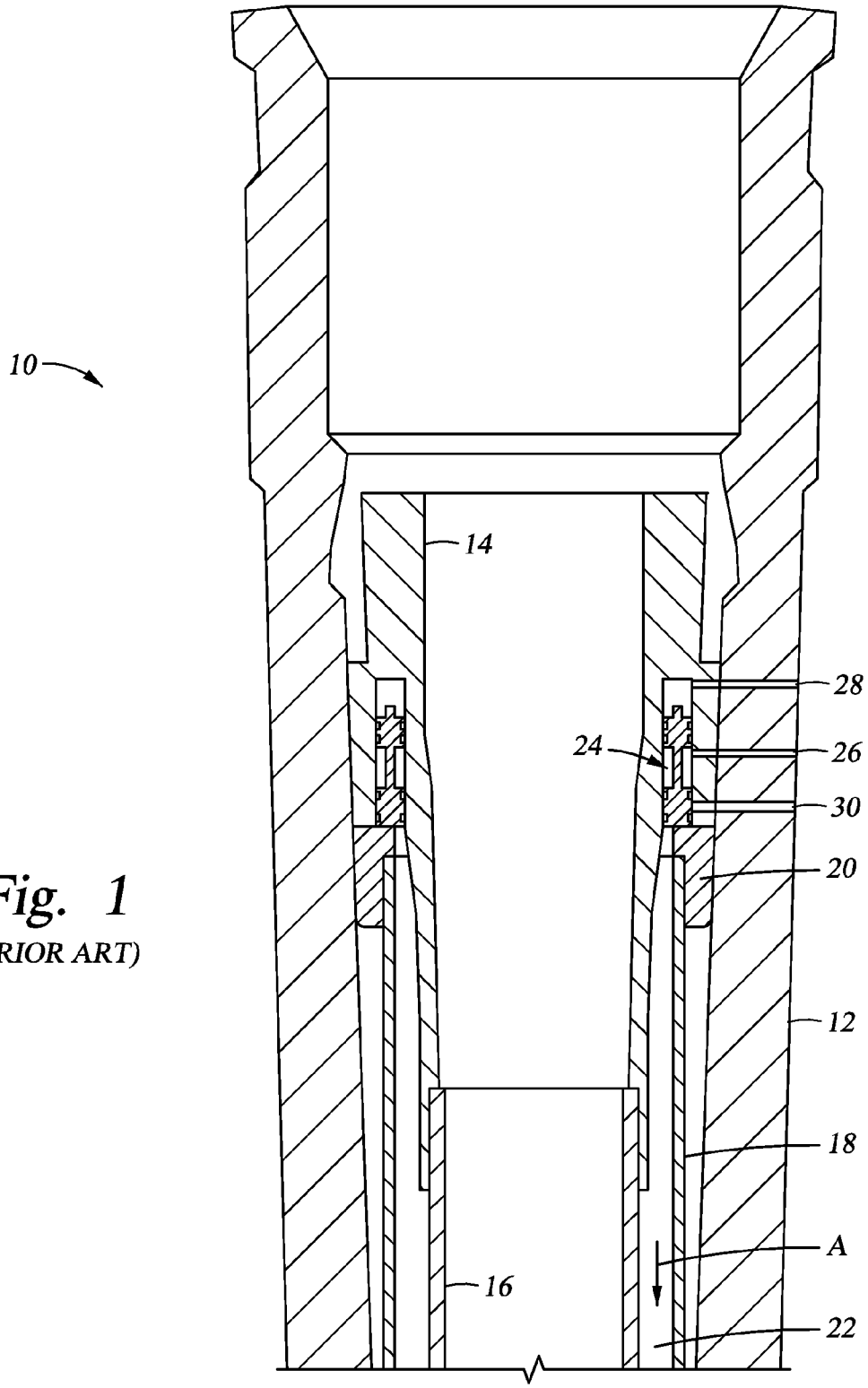
Fig. 1 (PRIOR ART)
FIG. 1 is a side partial sectional view of a prior art wellhead assembly.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Figure 2:
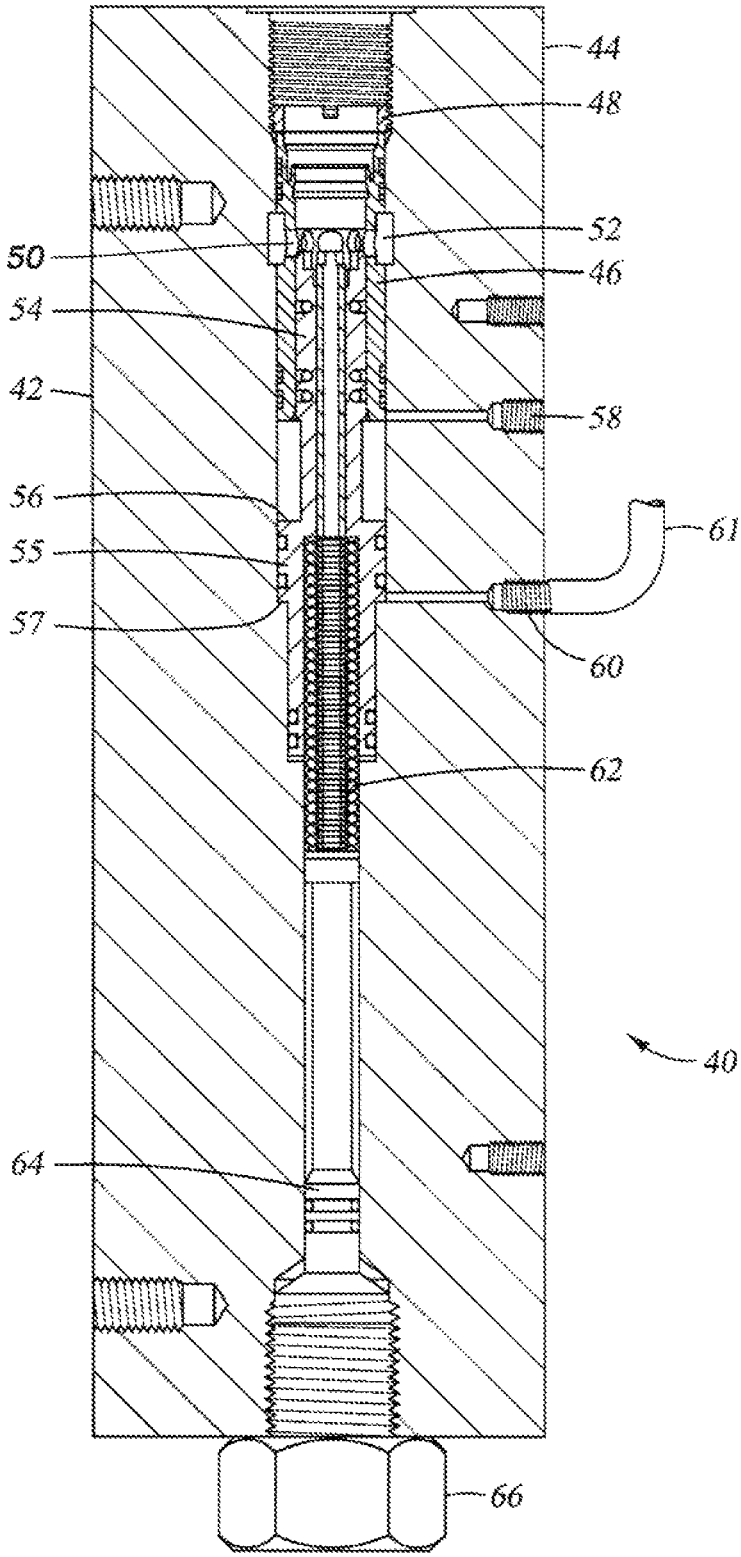
FIG. 2 is a side sectional view of an example embodiment of a shuttle valve in an open position and in accordance with the present disclosure.

An example of a shuttle valve assembly 40 in accordance with the present disclosure is shown in a side sectional view in FIG. 2. The shuttle valve assembly 40 of FIG. 2 is set in a bore 42 formed axially through a tubing hanger 44. An annular sleeve 46 is retained within a portion of the bore 42 by an annular locknut 48 shown abutting an end of the sleeve 46. Gallery ports 50 project radially through the sleeve 46 into fluid communication with an annular groove 52 formed in the outer wall of the bore 42. An elongate piston 54 is shown coaxial within the bore 42; an end of the piston 54 inserts within the sleeve 46. A shoulder 55 is provided along a portion of the outer surface of the piston 54 and disposed a distance from the sleeve 46. The shoulder 55 is defined along a region where the piston 54 extends radially outward to form a forward and a rearward face 56, 57; where the forward face 56 is on the end of the shoulder 55 proximate the sleeve 46, and the rearward face 57 is on the end of the shoulder distal the sleeve 46.

Still referring to FIG. 2, an opening port 58 projects radially into the housing 42 and into fluid communication with the bore 42. The opening port 58 intersects the bore 42 adjacent the side of the sleeve 46 that faces the shoulder 55. A closing port 60 projects radially inward from an outer surface of the body 42 and into fluid communication with the bore 42. The closing port 60 intersects the bore 42 adjacent the forward face 56 of the shoulder 55. A flow line 61 is shown that couples on the closing port 60 for providing fluid communication between the port 60 and a source of pressurized fluid (not shown). A spring 62 is shown having an end inserted into an axial bore 63 formed in an end of the piston 54 distal from the sleeve 46. An opposite end of the spring 62 abuts a stem 64 secured within the bore 42 to compress the spring 62 between the piston 54 and stem 64. A bolt head 66 on the outer end of the stem 64 threadingly secures the stem 64 into the body 42 so that the compressed spring 62 imparts a biasing force to further insert the piston 54 into the sleeve 46. The shuttle valve 40 of FIG. 2 is in an open position thereby providing fluid communication from within the bore 42, through the gallery ports 50 and into the annular groove 52. The annular groove 52 couples with a flow path (not shown) in fluid communication with or ambient to a wellhead assembly (not shown).

Figure 3:
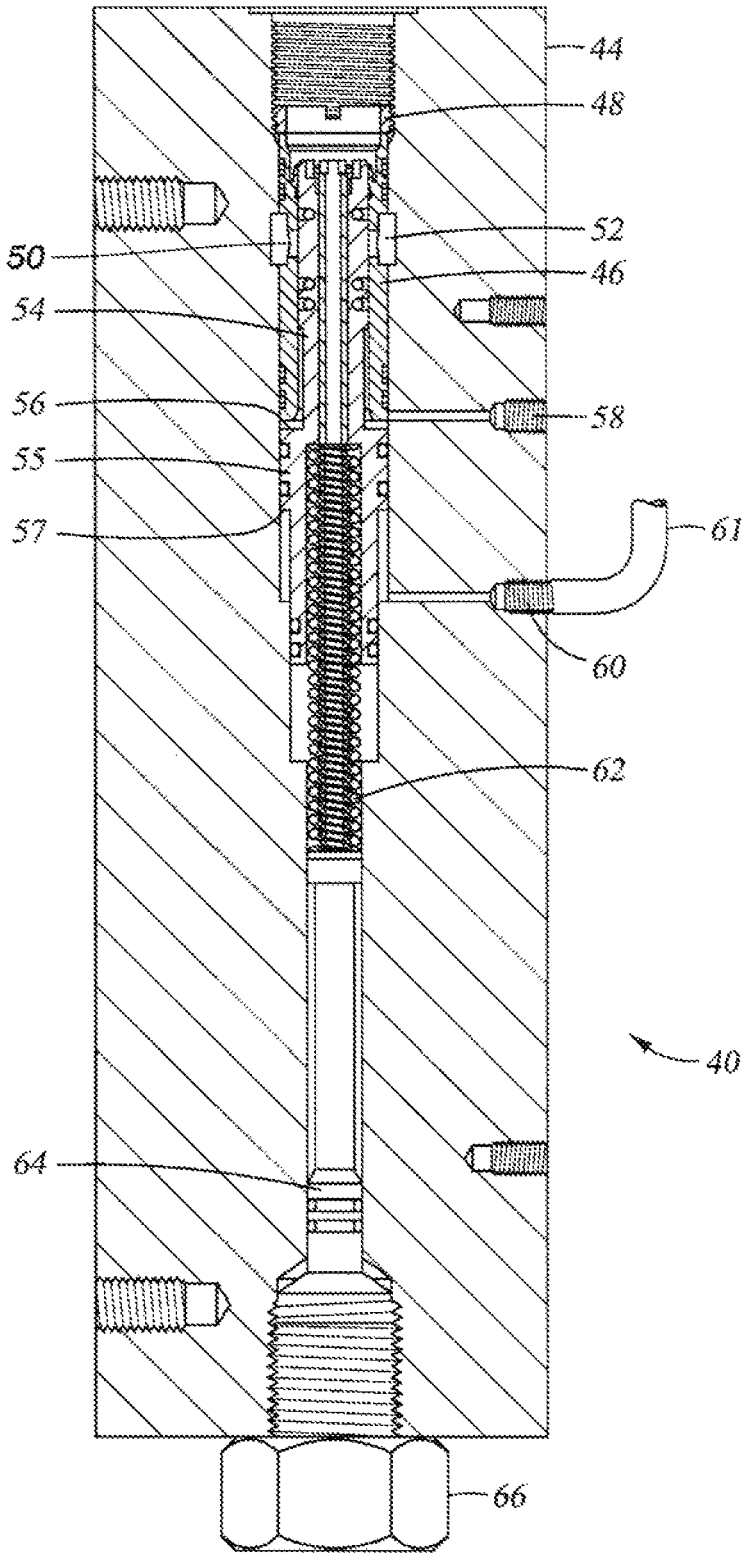
FIG. 3 is a side sectional view of the valve assembly of FIG. 2 in a closed position.

FIG. 3 illustrates in a side sectional view the shuttle valve 40 of FIG. 2 in a closed position. In this example, the piston 54 is shown further inserted within the sleeve 46 and blocking fluid communication from within the bore 42 and through the gallery ports 50. In an example of use, the piston 54 is urged within the bore 42 by controlling pressure in the opening and/or closing ports 58, 60 to create a pressure differential across the shoulder 56. When pressure at the closing port 60 exceeds pressure at the opening port 58 sufficiently to overcome sliding friction, the piston 54 moves from the position of FIG. 2 to the position of FIG. 3 to close the shuttle valve 40. Optionally, such as in a case when pressures are substantially equal at the opening/closing portions 58, 60, the force in the compressed spring 62 may urge the piston 54 into a closing position. Moving the piston 54 away from the stem 64 allows the spring 62 to elongate from the compressed configuration of FIG. 2. When the piston 54 is in the closed position, the shoulder 55 is in contact with an end of the sleeve 46 opposite the locknut 48.

Figure 4:
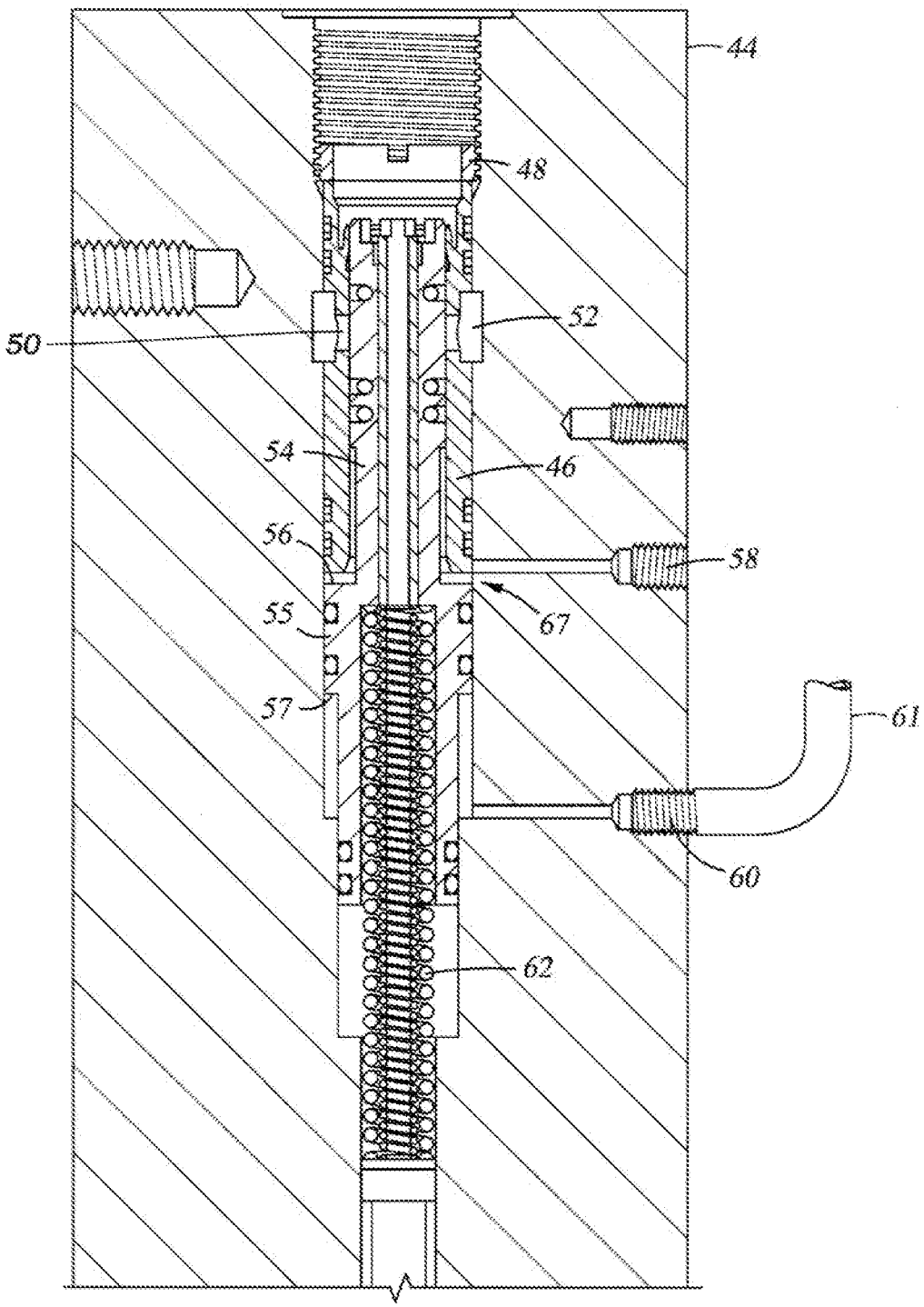
FIG. 4 is a side sectional view of the valve assembly of FIG. 2 in a partially closed position.

Shown in a side sectional view in FIG. 4 is an example of the shuttle valve 40 in a partially closed position. In this example, the piston 54 is urged from the open position of FIG. 2 toward the closed position of FIG. 3. However, due to friction between the piston 54 and bore 42, the front face 56 of the shoulder 55 is spaced apart from the sleeve 46 thereby leaving a gap 67 between the front face 56 and sleeve 46. A partially closed configuration may occur when an ability to apply pressure at the open and/or closing ports 58, 60 is lost and the closing function is performed solely by expansion of the spring 62.

Figure 5:
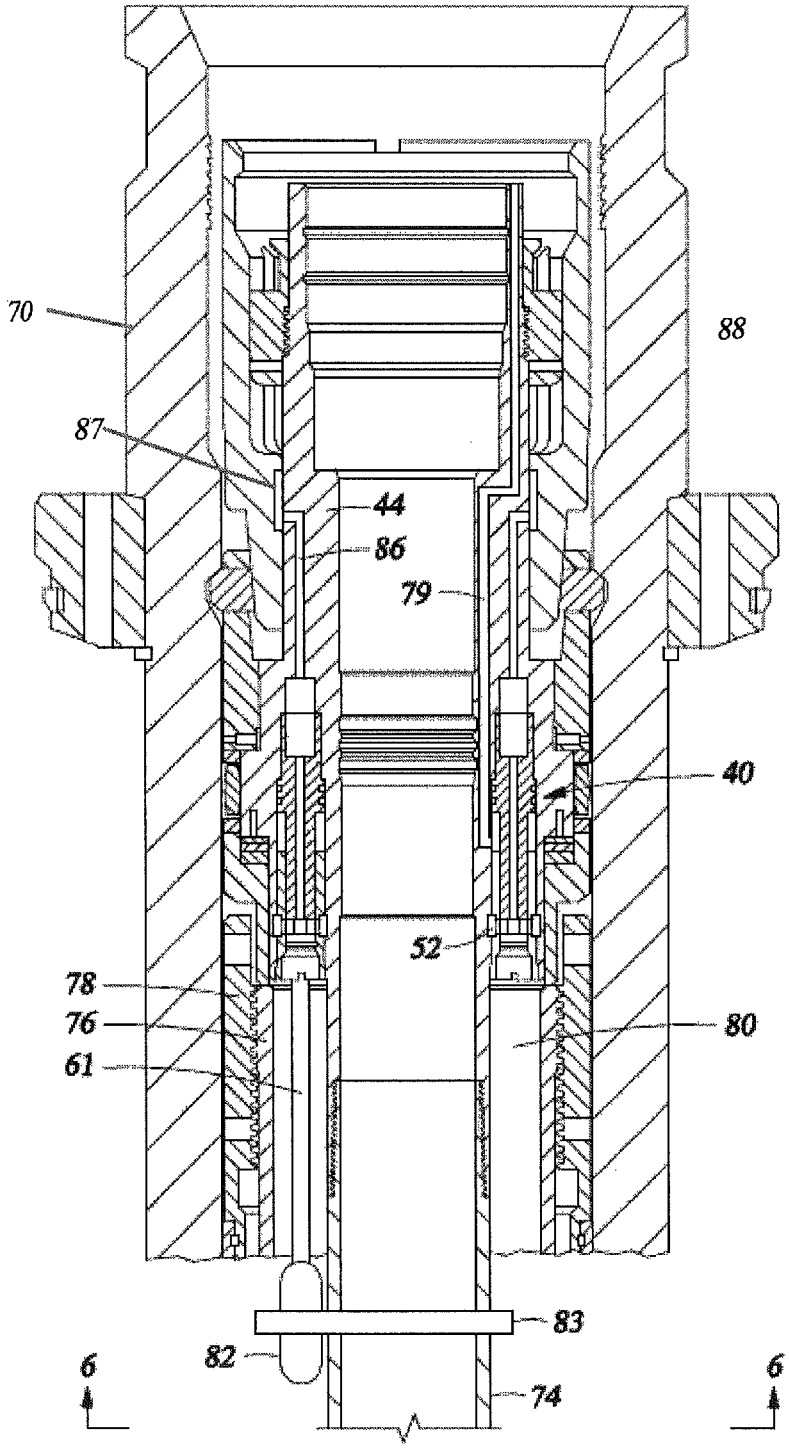
FIG. 5 is a side partial sectional view of a wellhead assembly in accordance with the present disclosure.

Referring now to FIG. 5, an example of a wellhead assembly 68 is illustrated in accordance with present disclosure. The wellhead assembly 68 is shown having an annular wellhead housing 70 on its outer periphery and a tubing hanger 44 concentric within the wellhead housing 70. Tubing 74 depends downward into a well bore (not shown) from the tubing hanger 44. Casing 76 circumscribes the tubing 74 and a portion of the tubing hanger 44 thereby defining an annulus 80 between the tubing 74 and tubing hanger 44, and casing 76. A casing hanger 78 is illustrated for supporting the casing 76 within the wellhead assembly 68. Cavities are formed in the tubing hanger 44 and configured to receive shuttle valves 40 therein. An opening line 79 is shown formed axially from an upper end of the tubing hanger 44 downward adjacent to the shuttled valve 40, and into fluid communication with the shuttle valve 40. Supplying pressurized fluid into the opening line 79 can actuate the shuttle valve 40 into the open position. In the open position, a flow passage 86 is put into fluid communication with the annulus 80 through the shuttle valve 40, thereby providing access to the annulus 80 from ambient to the wellhead assembly 68. The flow passage 86 is formed through the tubing hanger 44 and has an end facing the annular groove 52. Coursing upward through the tubing hanger 44, and then radially outward, the flow passage 86 intersects an annular groove 87 in the wellhead assembly shown circumscribing an upper portion of the tubing hanger 44. The groove 87 is in fluid communication with an annulus 88 in the wellhead assembly and above the groove 87.

In the example of FIG. 5 an accumulator 82 is illustrated in fluid communication with the flow line 61 coupled to the closing port 60 of the shuttle valve 40 (FIG. 2). In an example, the accumulator 82 is a closed system, such as a vessel or piping circuit, that may be pressurized for storing a potential closing force for closing the shuttle valve 40. In an example embodiment, the accumulator 82 is pressurized prior to being installed. When the shuttle valve 40 is moved to the open position, the piston 54 urges fluid through the flow line 61 towards the accumulator 82 thereby increasing pressure in the accumulator 82. Thus, energy for closing the shuttle valve 40 can be stored each time the shuttle valve 40 is opened and also made available apart from spring actuation. Optionally, tubing (not shown) could connect to the accumulator 82 for pressurizing the accumulator 82 after installation. By providing sufficient pressure to the accumulator 82, the shuttle valve 40 can be moved into the closed position when pressure is removed from the opening line 79; where removing pressure from the opening line 79 can be intended or from a loss of pressure supply. An additional advantage of the accumulator 82 is that a closing function to the shuttle valve 40 is provided without consuming space in the wellhead assembly 68. Accordingly, other control lines may be included within the space no longer occupied by the flow line for closing the shuttle valve 40.

Figure 6:
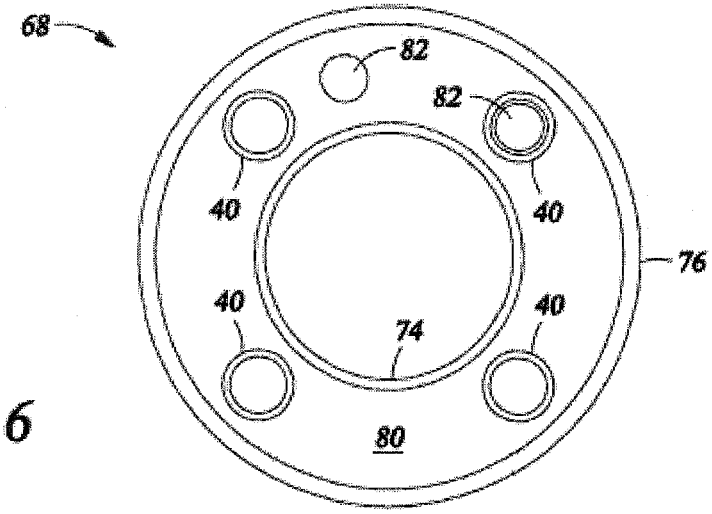
FIG. 6 is an axial sectional view of an example embodiment of the wellhead assembly of FIG. 5.
Figure 7:
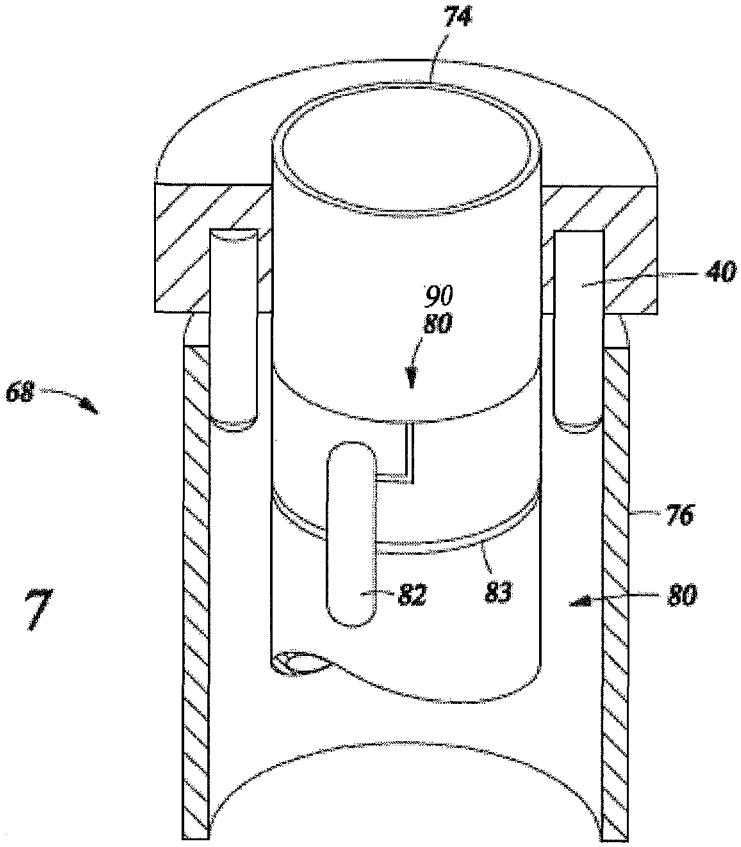
FIG. 7 is a side partial sectional view of an example embodiment of the wellhead assembly of FIG. 5.

Shown in FIG. 6, is an axial partial sectional view of the wellhead assembly 68 looking upward from below the shuttle valves 40 and accumulator 82. In this example, multiple shuttle valves 40 are shown disposed within the annulus 80 at various angular positions. Also, more than one accumulator 82 is illustrated provided within the annulus 80. In the example embodiment of FIG. 6, the accumulators 82 may be offset from a shuttle valve 40, or may be directly below a shuttle valve 40. Shown in a side partial sectional view in FIG. 7 is an example embodiment of the wellhead assembly 68 wherein more than one shuttle valve 40 is in fluid communication with an accumulator 82. In this example an accumulator circuit 83 stems between the shuttle valves 40 and into pressure communication with an accumulator 82.

While the invention has been shown or described in only some of its forms, it should be apparent to those skilled in the art that it is not so limited, but is susceptible to various changes without departing from the scope of the invention.

What is claimed is:

1. A wellhead assembly, comprising:

a wellhead member having an axis;

a tubing hanger set in the wellhead member for supporting a string of tubing extending into the well, defining a tubing annulus below the tubing hanger;

a shuttle valve assembly located within a cavity in the tubing hanger comprising:

a piston selectively slidable in axial directions between a normally closed position and an open position;

a flow path extending through the tubing hanger, into the tubing annulus, and through the shuttle valve assembly for flowing annulus fluid between the tubing annulus and an exterior of the tubing hanger when the piston is in the open position;

an accumulator mounted below the tubing hanger in the tubing annulus, the accumulator comprising a vessel containing a pressurized fluid, the vessel being pressurized with the pressurized fluid prior to installing the tubing hanger in the wellhead member;

a closing function flow line extending from the accumulator to the cavity for applying continuous closing fluid pressure to one side of the piston, continuously urging the piston to maintain shuttle valve in the normally closed position; and an open function flow passage extending through the tubing hanger from an exterior of the tubing hanger to an opposite side of the piston for selectively supplying opening fluid pressure to move the piston from the normally closed position to the open position while the accumulator continues to supply closure fluid pressure to said one side of the piston.

2. The wellhead assembly of claim 1, wherein the wellhead member is selected from the list consisting of a wellhead housing and a production tree.

3. The wellhead assembly of claim 1, wherein the accumulator is pressurized to a pressure above an ambient pressure.

4. The wellhead assembly of claim 1, further comprising a spring that functions in combination with the accumulator to urge the piston into the closed position.

5. The wellhead assembly of claim 1, wherein when the piston is moved into the open position, the piston urges fluid through the closing function flow line back into the accumulator, increasing the pressure of the fluid in the accumulator.

6. The wellhead assembly of claim 1, wherein when the valve is moved into the closed position, pressure in the accumulator decreases, and when the valve is moved into the open position, pressure in the accumulator increases.

7. The wellhead assembly of claim 1, wherein:

the shuttle valve assembly comprises a first shuttle valve assembly and wherein the flow path comprises a first flow path, the wellhead assembly further comprising a second shuttle valve assembly having a second piston slidable within a second cavity between a closed position and an open position; and the accumulator and the closing fluid flow line are connected to both of the cavities in parallel for urging both of the pistons to the closed position.

8. A wellhead assembly, comprising:

a wellhead member;

a tubing hanger set in the wellhead member;

tubing depending from the tubing hanger into a wellbore;

a tubing annulus circumscribing the tubing;

a shuttle valve in the tubing hanger;

a tubing annulus flow path extending through the tubing hanger, into the tubing annulus, and through the shuttle valve when the shuttle valve is in an open position and blocked when the shuttle valve is in a closed position;

a coil spring within the tubing hanger that urges the shuttle valve to the closed position;

an accumulator comprising a pressurized vessel mounted to and below the tubing hanger in the tubing annulus, the vessel being pressurized with a pressurized fluid prior to being installed in the wellhead member, the vessel being in fluid communication with a closing port on the shuttle valve for supplying continuous closing fluid pressure that combines with the coil spring to bias the shuttle valve into the closed position; and an opening port on the shuttle valve in selective fluid communication with opening fluid pressure to overcome the bias provided by the spring and the closing fluid pressure from the accumulator and move the shuttle valve into the open position.

9. The wellhead assembly of claim 8, wherein:

when the shuttle valve is moved into the closed position, the pressure of the fluid in the accumulator decreases; and when the shuttle valve is moved into the open position, the pressure of the fluid in the accumulator increases.

10. The wellhead assembly of claim 8, wherein:

the shuttle valve comprises a first shuttle valve and wherein the flow path comprises a first flow path, the wellhead assembly further comprising a second shuttle valve that selectively opens and closes a second flow path; and the accumulator is in fluid communication with and biases each of the first and second shuttle valves toward the closed position.

11. A method of controlling flow through a wellhead assembly having a tubing hanger supported in a wellhead housing, the tubing hanger having a tubing annulus flow passage extending from exterior of the tubing hanger to a tubing annulus below the tubing hanger, the method comprising:

providing a shuttle valve in a bore formed in the tubing hanger;

mounting an accumulator to and below the tubing hanger, the accumulator being a vessel;

pressurizing a fluid within the vessel; then installing the tubing hanger in the wellhead housing, which positions the accumulator in a tubing annulus below the tubing hanger;

continuously supplying the pressurized fluid from the accumulator to a closing side of the shuttle valve, maintaining the shuttle valve in a normally closed position to block fluid communication through the tubing annulus flow passage; and selectively directing opening fluid pressure from exterior of the wellhead assembly to an opening side of the shuttle valve to move the shuttle valve from the normally closed position to the open position to open fluid communication through the tubing annulus flow passage while the accumulator continues to supply pressurized fluid to the shuttle valve.

12. The method of claim 11, further comprising mounting a coil spring in the bore, and biasing the shuttle valve to the closed position in combination with the pressurized fluid from the accumulator.

13. The method of claim 11, wherein directing opening fluid pressure to the shuttle valve returns pressurized fluid from the shuttle valve to the accumulator.

* * * * *